US005834942A

United States Patent [19]

De Angelis

[11] Patent Number: 5,834,942

[45] Date of Patent: Nov. 10, 1998

[54] EQUIPMENT FOR DETERMINING WHEN SYNTHETIC FIBER CABLES ARE READY TO BE REPLACED

[75] Inventor: Claudio De Angelis, Lecerne, Switzerland

[73] Assignee: Inventio AG, Hergiswil NW, Switzerland

[21] Appl. No.: 851,847

[22] Filed: May 6, 1997

Related U.S. Application Data

[63] Continuation of Ser. No. 608,398, Feb. 28, 1996, abandoned.

[30] Foreign Application Priority Data

Mar. 6, 1995 [CH] Switzerland ..... 630/95

[51] Int. Cl.[6] ..... G01R 31/00; B66B 11/08

[52] U.S. Cl. ..... 324/522; 324/539; 324/543; 73/158; 187/226

[58] Field of Search ..... 324/522, 523, 324/525, 527, 539, 543; 73/862.39, 862.391, 862.392, 862.56, 158; 187/391, 226

[56] References Cited

U.S. PATENT DOCUMENTS

| | | | |
|---|---|---|---|
| 4,803,888 | 2/1989 | Choquet | 73/862.392 |
| 5,146,611 | 9/1992 | Stolarczyk | 455/40 |
| 5,195,393 | 3/1993 | Wolfington et al. | 74/502.5 |
| 5,262,234 | 11/1993 | Minor et al. | 428/372 |
| 5,477,152 | 12/1995 | Hayhurst | 324/539 X |
| 5,565,784 | 10/1996 | DeRenne | 324/543 X |
| 5,566,786 | 10/1996 | De Angelis et al. | 187/226 |

FOREIGN PATENT DOCUMENTS

| | | | |
|---|---|---|---|
| 735704 | 6/1979 | France . | |
| 2442393 | 3/1975 | Germany . | |
| 2853661 | 7/1980 | Germany . | |
| 232569 | 9/1990 | Japan | 324/543 |
| 2036825 | 7/1981 | United Kingdom . | |
| 2152088 | 7/1985 | United Kingdom . | |

*Primary Examiner*—Diep N. Do
*Attorney, Agent, or Firm*—Greenblum & Bernstein, P.L.C.

[57] ABSTRACT

An apparatus for determining when a synthetic fiber cable for an elevator is ready for replacement is disclosed. The apparatus includes at least one voltage detection unit for detecting a voltage in at least one carbon fiber of the synthetic fiber cable and at least one threshold device for determining when the detected voltage exceeds a predetermined voltage threshold. The detected voltage is dependent upon the integrity of the portion of the synthetic cable and exceeding the predetermined voltage threshold is indicative of a failure of the at least one portion of the synthetic cable. The apparatus also includes a device for disabling the elevator when a predetermined number of the at least one threshold device determine that the at least one carbon fiber of the synthetic fiber cable has failed. The synthetic fiber cable includes a plurality of strand layers and at least one carbon fiber, each strand layer including a plurality of strands of synthetic fibers, such as aramide. The apparatus further includes a current source to be coupled to the at least one carbon fiber.

20 Claims, 4 Drawing Sheets

EQUIPMENT FOR DETERMINING WHEN SYNTHETIC FIBER CABLES ARE READY TO BE REPLACED

CROSS REFERENCE OF RELATED APPLICATION

The present invention is based upon Swiss Patent Application No. 630/95-9 filed Mar. 6, 1995, the disclosure of which is incorporated herein by reference in its entirety. This application is a continuation of application Ser. No. 08/608,398, filed Feb. 28, 1996, now abandoned.

BACKGROUND OF THE INVENTION

1. Field of the Invention

The present invention is related to equipment for recognizing when synthetic fiber cables for elevators are ready to be replaced.

2. Discussion of the Background of the Invention and Material Information

Until recently, steel cables were generally used in elevator construction. The steel cables were connected with the cages or with the load-receiving device and counterweights. These running steel cables, however, do not last forever. Due to increasing stresses, friction and wear, wire fractures gradually occur in the bending zones. These fractures occur due to a combination of different loads on the elevator cables, low tension stresses, and high pressures at high cycle rates. In elevator construction, one speaks of a controllable cable failure. This means that the danger-free remaining period of use can be read off from an outward degree of destruction of the cable. That is, from the number of wire fractures and from the number of outward wire fractures, the remaining cable fracture resistance may be deduced, however, only conditionally. Internal wire fractures remain unnoticed in some circumstances. By reason thereof, the replacing wire fracture number is defined by a certain number of wire fractures over a cable portion. The tester physically counts the number of wire fractures. When it is determined to be time for replacing the wire cable in accordance with the wire fracture number, an adequate remaining fracture resistance, which exceeds the increasing cable tension force, remains maintained in the normal case.

To this extent, a synthetic fiber cable cannot be compared with a steel cable. Because of the manner in which synthetic fiber cables are manufactured, the above-described method for determining the readiness for replacing cannot be used for the determination of the state of wear of a synthetic fiber cable. Further, the outer sheath prevents visual recognition of fiber or strand fractures.

A synthetic fiber cable, in which one or more electrically conductive indicator fibers are placed into the strands in order to monitor the state of the cable, has been shown in GB-PS 2 152 088. The carbon indicator fiber surrounded by the synthetic fibers and the strand must have the same mechanical properties so that they fail at the same time. A tearing of the fiber may be detected by applying a voltage to the indicator fiber. In this manner, each individual strand of a synthetic fiber cable can be checked and the cable can be replaced when a predetermined number of torn strands have been exceeded.

In the case of the above-mentioned patent, the indicator fibers are arranged so that they tear at the same time as the carrying strands. In the extreme case, an adequate residual fracture resistance is difficult to maintain, since the tearing of an indicator fiber signifies failure of an entire carrying strand, not only an individual fiber of one strand. The time span between an apparently intact cable and a necessary replacement of the cable is very small on the basis of this method. The progress of wear is thus not recognizable. This equipment cannot meet the safety requirements in the elevator construction. Furthermore, diameter reduction of the synthetic fiber cable or wear of the sheath may not be recognized after a great number of bending cycles.

SUMMARY OF THE INVENTION

The present invention is directed to recognizing the proper time for replacing synthetic fiber cable used for an elevator, which does not display the aforementioned disadvantages and in which the exchanging of the cables reliably takes place in good time, and not unnecessarily prematurely.

Accordingly, one aspect of the present invention is directed to an apparatus for determining when a synthetic fiber cable for an elevator is ready for replacement. The apparatus includes at least one voltage detection unit for detecting a voltage in at least one portion of the synthetic fiber cable, the voltage dependent upon the integrity of the portion of the synthetic cable, at least one threshold device for determining when the detected voltage exceeds a predetermined voltage threshold, wherein exceeding the predetermined voltage threshold is indicative of a failure of the at least one portion of the synthetic cable. The apparatus also includes a device for disabling the elevator when a predetermined number of the at least one threshold device determine that the at least one portion of the synthetic fiber cable has failed.

According to another aspect of the present invention, the synthetic fiber cable includes a plurality of strand layers and the at least one portion, each strand layer including a plurality of strands of synthetic fibers and the at least one portion including at least one electrically conductive fiber. The apparatus further includes a current source to be coupled to the at least one electrically conductive fiber.

According to a further aspect of the present invention, the at least one electrically conductive fiber includes at least one carbon fiber, the plurality of strands of synthetic fibers including aramide fibers, and the at least one carbon fiber including a lower specific expansion and a lower bending fatigue strength than the aramide fibers.

The advantages achieved by the present invention are that an accurate judgment of the remaining fracture resistance of the synthetic fiber cable is possible due to different properties of the conducting indicator fibers and the carrying fibers. Advantageous developments of, and improvements in, the recognition of readiness for replacing synthetic fiber cables are possible. Each strand layer of the synthetic fiber cable may include more than one indicator fiber so that an accident or error in the judgment of the state of the cable may be avoided. A respective color can be allocated to each layer of the carbon indicator fibers twisted with the fibers into strands in order to simplify connection to a current source. Indicator fibers in at least each strand layer enable a predictive estimation of the instant of replacing. Automatic checking of the cable takes place at certain intervals by an inspection control coupled to the indicator fibers. On exceeding a limit value, the elevator is automatically driven to a certain stopping place and switched off. Moreover, the cable may be equipped with a two-layer differently colored sheath so that the degree of wear of the cable can be optically checked in a simple mode and manner.

BRIEF DESCRIPTION OF THE DRAWING FIGURES

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENT

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
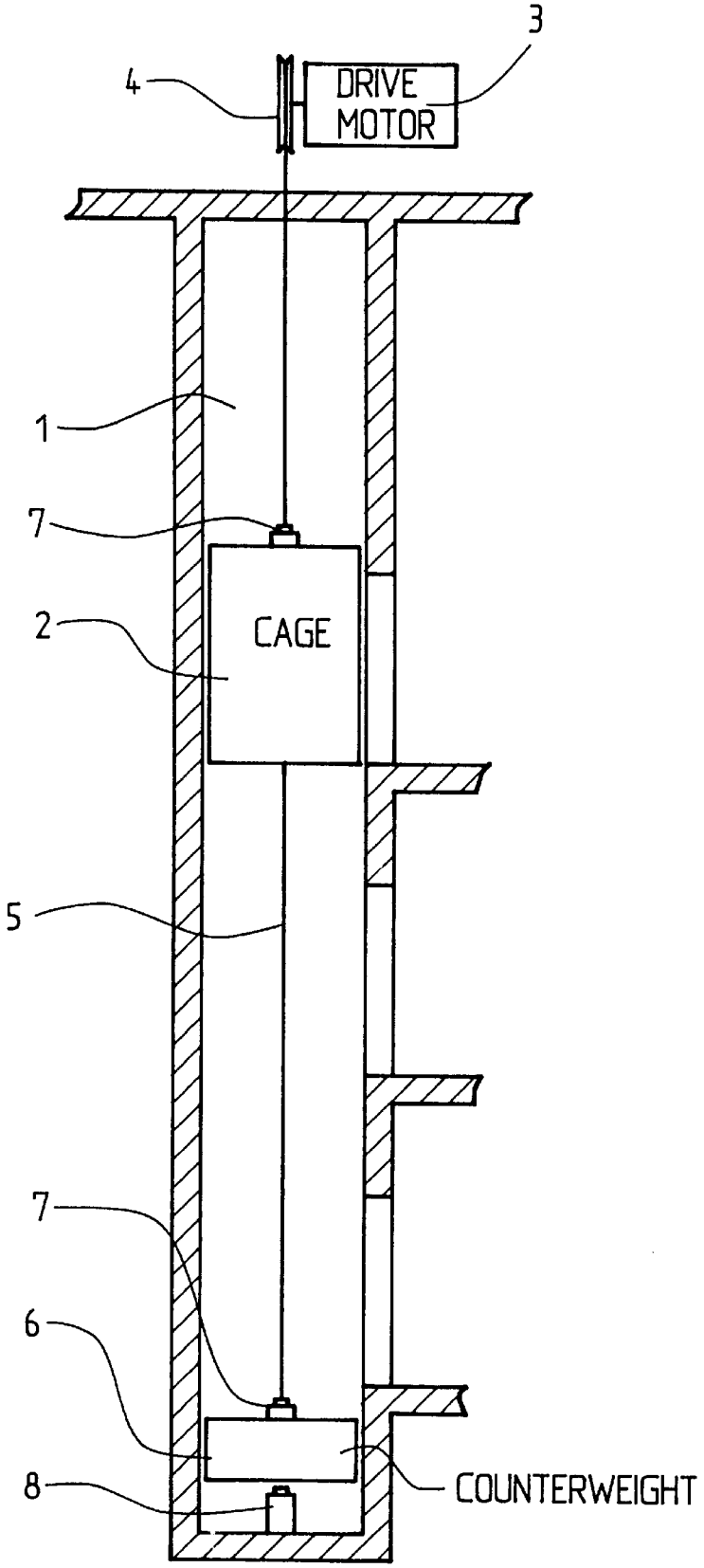
FIG. 1 shows a schematic illustration of an elevator installation.

FIG. 1 shows a schematic illustration of an elevator installation. A cage 2 guided in an elevator shaft 1 is driven by a synthetic fiber cable 5 and a drive motor 3 with a drive pulley 4. A counterweight 6, as a compensating organ, hangs at the other end of cable 5. The fastening of cable 5 to cage 2 and to counterweight 6 takes place by cable end connections 7. The coefficient of friction between cable 5 and drive pulley 4 is such that cage 2 is prevented from movement when counterweight 6 is sitting down on a buffer 8.

Figure 3:
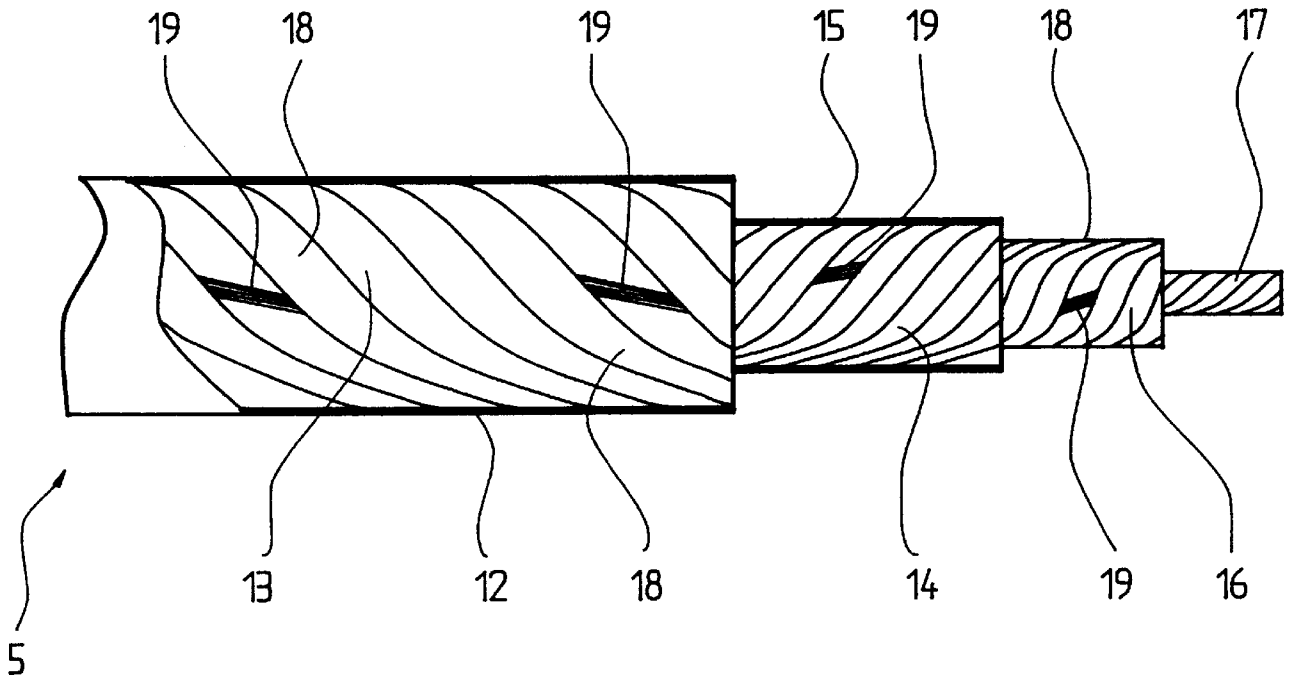
FIGS. 2 and 3 show a synthetic fiber cable with indicator fibers.
Figure 2:
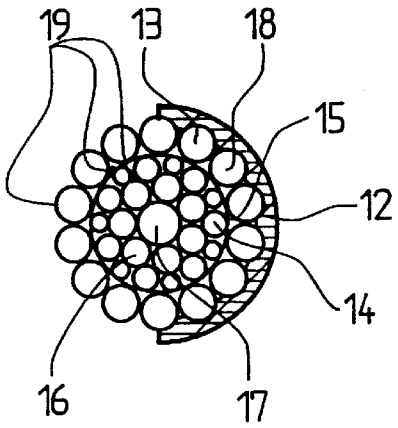

FIGS. 2 and 3 show a synthetic fiber cable 5 with indicator fibers. Synthetic fiber cable 5 is designed to be arranged in three concentric layers. A protective sheath 12 surrounds an outermost strand layer 13. A friction-reducing support sheath 15 is applied between a middle strand layer 14 and outermost strand layer 13. An inner strand layer 16 and a cable core 17 are arranged within middle strand layer 14. The strands 18 are twisted from individual aramide fibers. Each individual strand 18 is treated by an impregnating medium, for example polyurethane solution, for protecting the aramide fibers. The principle of detecting readiness for replacing the cable is based on the combination of two fiber types with different properties into a simple strand 18. One fiber, the aramide, has a high fatigue strength to bending and a high specific expansion. The other fiber, a carbon fiber 19, is more brittle and thus exhibits less resistance to repeated bending and a lower fracture elongation than the aramide fibers. The synthetic fiber cable according to the present application comprise a composition of carbon indicator fibers 19 that may be approximately 30% to 75% of the composition of the aramide fibers. According to the different cable tension stresses occurring in cable 5, the carbon indicator fibers 19 with different fracture elongations are positioned in the cable 5. Because of the manner of manufacturing the cable, strand length reduces towards core 17 of cable 5 so that the inner strands will display the least elongation in running operation. Conductive fibers with fracture elongations reducing toward cable core 17 are used for the indicator fibers 19 in correspondence with the elongation. The number of the torn carbon indicator fibers 19 can be ascertained with a voltage source.

Figure 4:
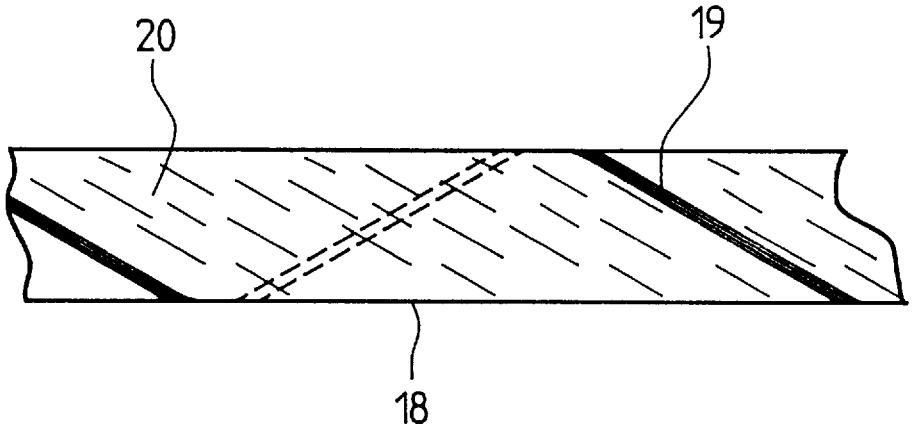
FIG. 4 shows a strand of synthetic fiber cable with a carbon indicator fiber.

FIG. 4 shows a strand 18 of a synthetic fiber cable 5 with a carbon indicator fiber 19. Both fiber types, the aramide fibers 20 and the carbon fibers 19, are arranged in parallel and twisted together in the production of strand 18. In this case, carbon fiber 19 can also be placed exactly in the center of the strand 18 or extend helically. The carbon fiber 19 should be arranged within the impregnating medium so that adequate protection against pressure and friction may be achieved. Otherwise, premature failure of carbon indicator fiber 19 would occur and cable 5 would erroneously appear to be ready for replacing. In running operation, the carbon indicator fiber 19 of a strand 18 will, either by reason of too great elongations or too great a number of bending cycles, always tear or break before the aramide fibers 20, which distinguish themselves by extraordinarily good dynamic properties.

Figure 5:
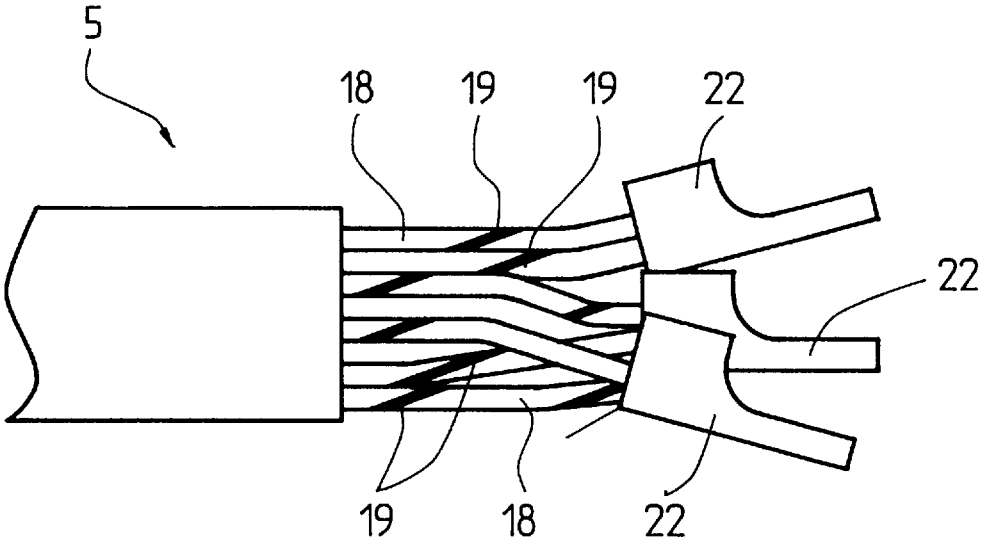
FIG. 5 shows a contact-making of indicator fibers at one cable end.

FIG. 5 shows a contact-making of the carbon indicator fibers 19 at one end of cable 5. The good electrical conductivity of the carbon indicator fibers 19 is important for recognizing readiness for replacing. The indicator fiber 19 is placed in at least two strands 18 either in each strand layer 13, 14 and 16 or in the outermost and innermost strand layers 13 and 16. In a few cases, only a single indicator fiber 19 may be necessary in individual strand layers 13, 14 and 16. In the case of elevators suspended 1:1, two indicator fibers 19 of one strand layer 13, 14 and 16 are always connected together or in series by connecting elements 22 on counterweight 6. In the case of installations suspended 2:1, this operation can be performed in the machine room. Indicator fibers 19 are removed the compound of the cable end led out of the cable end fastening and always connected together in pairs. On cage 2, the cable ends are likewise led out of the cable end connection 7 and the indicator fibers 19 are removed from the cable compound. There, the carbon indicator fibers 19 belonging together are searched out by means of a continuity measurement and connected with identified electrical lines. These lines lead into an inspection control on the cage 2. In order to simplify the connection to the inspection control, different colors are allocated to the individual strand layers 13, 14 and 16. All necessary electronic components, which enable a constant checking of the synthetic fiber cable 5, are disposed in the inspection control.

Figure 6:
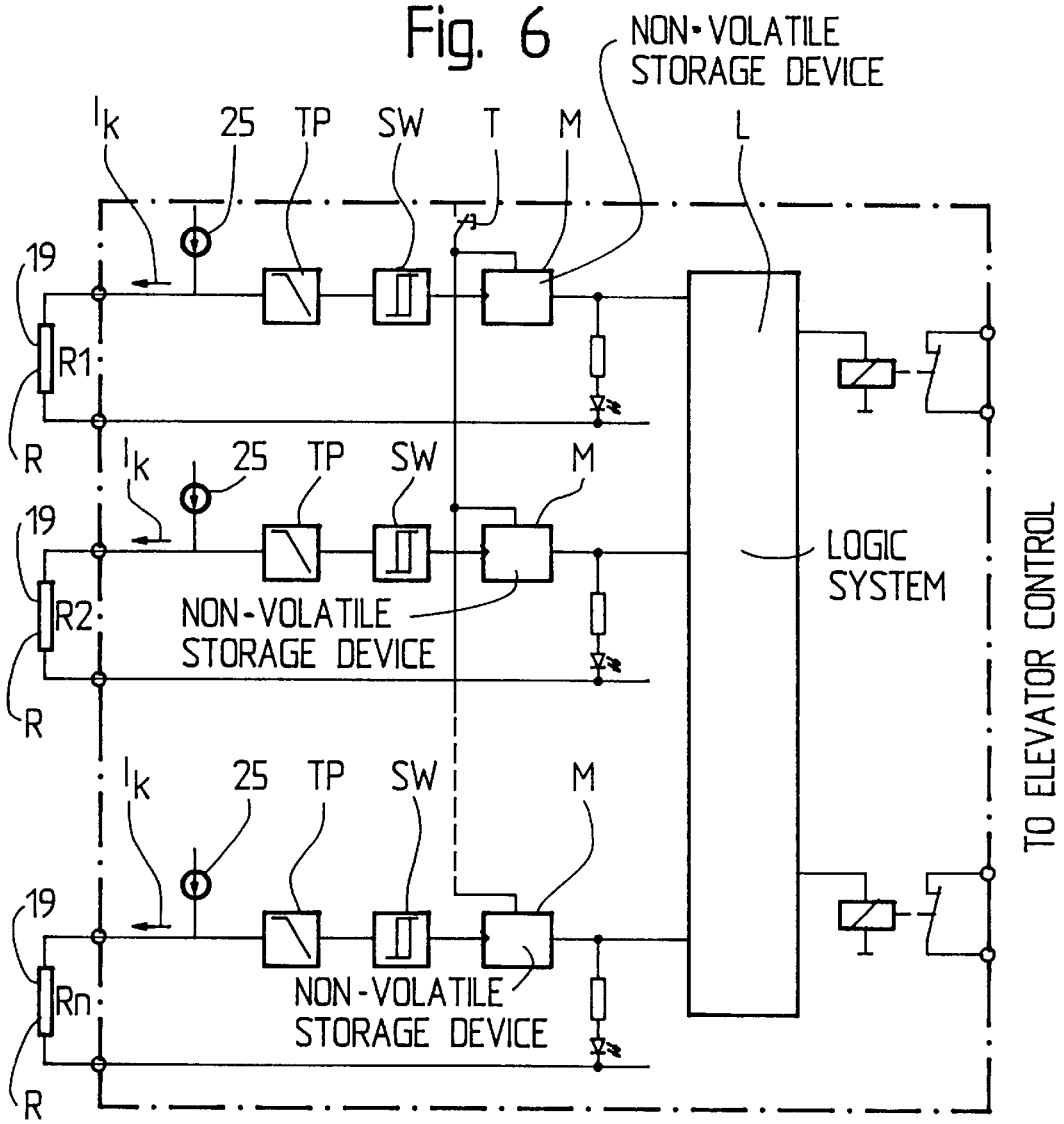
FIG. 6 shows a circuit diagram of an inspection control.

FIG. 6 shows a circuit diagram of the inspection control. A constant current Ik is fed by way of a current source 25 into the indicator fiber 19 running to the counterweight 6. The carbon indicator fiber 19 represents a resistance R. Low-pass filter TP filters the incoming pulses and leads these to a threshold value switch SW. The threshold value switch SW compares the measured voltages. When predetermined limit values are exceeded, i.e., by torn indicator fibers 19, the resistance becomes so great that the permissible voltage value is exceeded. This instance of exceeding of the predetermined limit value is stored in a non-volatile storage device M. Storage device M may be erased by a reset key T or may pass its information to a logic system L disposed on the cage 2. Logic system L is interrogated automatically by the elevator control. Each indicator pairing is wired according to the aforementioned arrangement and checked constantly. The elevator control constantly checks the logic system and switches the elevator off when too many fiber tears are identified by the logic system.

In order that a certain residual carrying capacity of the cable 5 can be ensured, only a certain percentage of the indicator fibers 19 may fail. This percentage may, depending on the dimensions of the carbon indicator fibers 19, lie between 20% and 80% with reference to all carbon indicator fibers 19. Then, the elevator is automatically moved to a predetermined stopping place and switched off. Fault reports can be passed on and indicated by way of a display. The state of wear on the cable 5 may be communicated by modem from any desired location.

This recognition of the readiness for replacing also enables the treating of strands 18, which are arranged in the middle one or innermost strand layers 14 and 16 of the cable 5 without a visual judgment of an inductive testing being necessary. In order that account can be taken of the different mechanical stress states in the strand layers 13, 14 and 16 in the synthetic fiber cable 5, carbon indicator fibers 19 with appropriate fracture elongations are associated with the individual layers 13, 14 and 16. Indicator fibers 19 with a somewhat higher fracture elongation can be associated with the outermost indicator fibers 19, which apart from the pressure have to suffer the highest thrust loadings. In this way, an optimally controlled cable wear analysis may be achieved.

Figure 7:
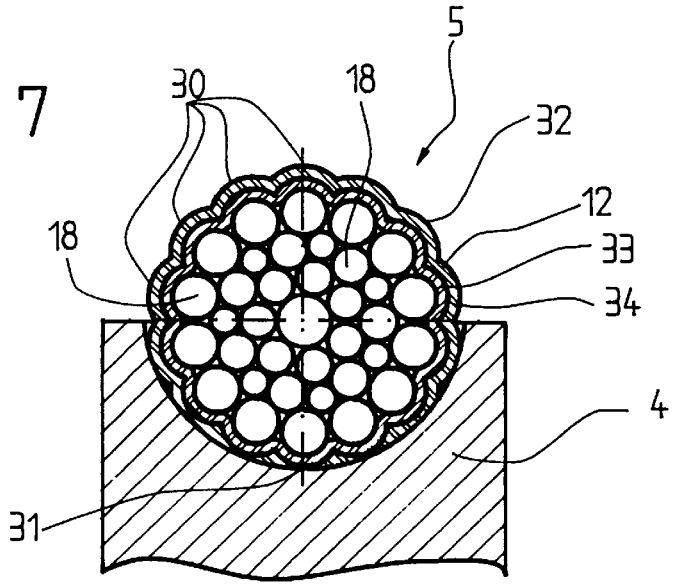
FIG. 7 shows a synthetic fiber cable in cross-section with a multicolored sheath.

FIG. 7 shows a synthetic fiber cable in cross-section with multicolored sheath. The available cable sheath surface is checked for the visual judgment of a synthetic fiber cable 5 for a state of wear possibly ready for replacing. For this purpose, it must be possible to assure that wear of the cable sheath 12 takes place at the surface. This wear is caused by the slip which occurs in running operation. The slip represents the measure of relative movement between cable 5 and drive pulley 4 and is defined as the difference between the speeds of cable 5 and drive pulley 4. When cable 5 running on drive pulley 4 does not run at the same speed as drive pulley 4, sliding slip occurs. When cable 5 runs over drive pulley 4, the weights hanging at both sides cause different cable tension forces, causing an elongation slip in both directions, even if the driving capacity were to be sufficiently great. Cable 5, due to the different cable tension forces, has different stresses acting upon it in front of and behind drive pulley 4. Thus, different elongations occur in front of and behind drive pulley 4. While cable 5 runs over drive pulley 4, the new state of elongation results by slipping of cable 5. For a small cable force ratio, the resulting slipping movement occurs in the region of the running-off point, i.e., where slipping takes place over the entire looping arc of drive pulley 4 in the case of fully exhausted driving capacity.

Cable 5 always slides on drive pulley 4 in the direction of the greater cable tension force and independently of the direction of rotation of drive pulley 4. The magnitude of elongation slip increases according to the driving capacity of cable sheath 12 and the groove geometry of drive pulley 4.

Cable sheath 12 may have a surface corresponding to the strand structure, i.e., denoted as a hill and valley structure. Because synthetic fiber cable 5 runs over cast iron (or steel) drive pulley 4, cable sheath 12 is no longer subject to abrasive wear. Thus, a defined running surface 30 can be spoken of in principle. Possible liquids on the drive pulley 4 may be displaced by defined running surface 30 due to the hill and valley structure of cable sheath 12. The greatest pressures acting on sheathed strands 18 are exerted in groove base 31 of drive pulley 4 on hill regions 32 of cable 5. Consequently, the greatest wear phenomena may be found there. Surface wear is primarily produced by expansion slip, and to a lesser extent by the sliding slip. From experiences with steel cables, the greatest changes may be observed on the acceleration path portions. In order to ascertain the amount of the wear, visual analysis may be employed by the tester to determine whether sufficient sheath thickness is present until the next test. Cable sheath 12 may be extruded with an inner color 33 and an outer color 34. The thickness of the inner extrusion of the cable, i.e., inner color 33, measures a specific thickness which ensures a sufficiently great running capacity. Sheath 12 protects strands 18 and produces the necessary traction capability. When the tester observes the extruded-in inner color 33 of sheath 12 on a visual check, it is determined that cable 5 will require replacement in a foreseeable time.

For optimum determination of the cable state of a synthetic fiber cable, a combination of both testing methods, i.e., the self-checking by means of indicator fibers 19 and the visual sheath check with a two-colored sheath, should be applied.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed:

1. An apparatus for determining when a synthetic fiber cable for driving an elevator is ready for replacement, said apparatus comprising:

at least one portion of said synthetic cable capable of exhibiting a voltage and said at least one portion of said synthetic cable having a lower specific elongation and a lower bending fatigue strength than a remaining portion of said synthetic cable;

at least one voltage detector detecting said voltage in said at least one portion of said synthetic fiber cable, said voltage dependent upon an integrity of said at least one portion of said synthetic cable; and at least one threshold detector determining when said detected voltage exceeds a predetermined voltage threshold, wherein exceeding said predetermined threshold is indicative of a failure of said at least one portion of said synthetic fiber cable.

2. The apparatus according to claim 1, said synthetic fiber cable comprising a plurality of strand layers and said at least one portion, each strand layer including a plurality of strands of synthetic fibers and said at least one portion comprising at least one electrically conductive fiber; and said apparatus further comprising a current source for coupling to said at least one electrically conductive fiber.

3. The apparatus according to claim 2, said at least one electrically conductive fiber comprising at least one carbon fiber; and each of said plurality of strands of synthetic fibers comprising a plurality of aramide fibers.

4. The apparatus according to claim 3, said at least one carbon fiber including a lower specific expansion and a lower bending fatigue strength than said aramide fibers; and wherein breaking elongations of said at least one carbon fiber decrease toward a core of said synthetic fiber cable.

5. The apparatus according to claim 3, said synthetic fiber cable further comprising at least one carbon fiber in each of said plurality of strand layers.

6. The apparatus according to claim 3, said at least one carbon fiber being twisted with said aramide fibers.

7. The apparatus according to claim 3, said at least one carbon fiber extending centrally through at least one of said plurality of strands.

8. The apparatus according to claim 3, said at least one carbon fiber extending helically along a surface of at least one of said plurality of strands.

9. The apparatus according to claim 1, further comprising a logic system for monitoring each of said at least one threshold detector.

10. The apparatus according to claim 2, wherein each of said plurality of strand layers are indicated by a different color.

11. The apparatus according to claim 2, said synthetic fiber cable further comprising an extruded protective sheath including an inner sheath color and an outer sheath color.

12. The apparatus according to claim 11, wherein said inner sheath color includes a thickness such that when said inner sheath color is visible, a sufficient running capacity for said synthetic fiber cable remains.

13. The apparatus according to claim 3, said at least one carbon fiber comprising at least one pair of carbon fibers interconnected by a connector coupled to a counter weight, wherein each pair of carbon fibers are coupled in series to a corresponding threshold detector.

14. The apparatus according to claim 13, said current source being coupled to a first of said pair of carbon fibers and applying a constant current;

said at least one voltage detection detecting a voltage across said pair of carbon fibers;

said detected voltage exceeding said predetermined voltage threshold when one of said pair of carbon fibers fails.

15. The apparatus according to claim 2, said electrically conductive fibers failing before said synthetic fibers.

16. The apparatus according to claim 2, said plurality of strand layers being concentrically arranged.

17. The apparatus according to claim 1, further comprising a disabling device disabling the elevator when a predetermined number of said at least one threshold detector determines that a predetermined number of said at least one portions of said synthetic fiber cable has failed.

18. An apparatus for determining when a synthetic fiber cable for driving an elevator is ready for replacement, said apparatus comprising:

a plurality of strand layers, each strand layer comprising a plurality of strands of synthetic fibers; and at least one portion of at least one of said plurality of strand layers comprising at least one electrically conductive carbon fiber, said at least one carbon fiber having a lower specific expansion and a lower bending fatigue strength than said synthetic fibers.

19. The apparatus according to claim 18, each of said plurality of strand layers being composed of at least one conductive carbon fiber having a lower specific expansion and a lower bending fatigue strength than said synthetic fibers.

20. The apparatus according to claim 18, said synthetic fibers being composed of aramide fibers.

* * * * *